United States Patent [19]

Greenberg

[11] Patent Number: 4,778,421

[45] Date of Patent: Oct. 18, 1988

[54] ENGINE BED FOR INBOARD-POWERED BOATS

[75] Inventor: Robert A. Greenberg, Melbourne, Fla.

[73] Assignee: Ray Industries, Inc., Knoxville, Tenn.

[21] Appl. No.: 47,262

[22] Filed: May 8, 1987

[51] Int. Cl.[4] ..... B63H 21/30

[52] U.S. Cl. ..... 440/111; 248/671

[58] Field of Search ..... 440/111, 112; 180/299, 180/300, 312; 248/637, 671, 674, 678

[56] References Cited

U.S. PATENT DOCUMENTS 1,384,169 7/1921 Theberath ..... 248/671 X 1,388,104 8/1921 Dotterweich ..... 248/671

1,698,453 1/1929 Sardeson et al. ..... 180/312

2,059,220 11/1936 Fernstrum ..... 440/111

*Primary Examiner*—Sherman D. Basinger

*Attorney, Agent, or Firm*—William H. Drummond

[57] ABSTRACT

An engine bed for locating an inboard engine in a powerboat hull and for transferring static and dynamic engine loads to load-bearing stringers formed integrally in the stern portion of the hull. The engine bed includes a transverse beam extending between the stringers under the forward motor mounts of the engine. Longitudinal flanges, formed integrally in the beam ends are rigidly secured to the stringers by through-bolts. The forward motor mounts of the engine are rigidly fixed to the beam at points spaced inwardly from the flanges.

1 Claim, 1 Drawing Sheet

FIG. 1
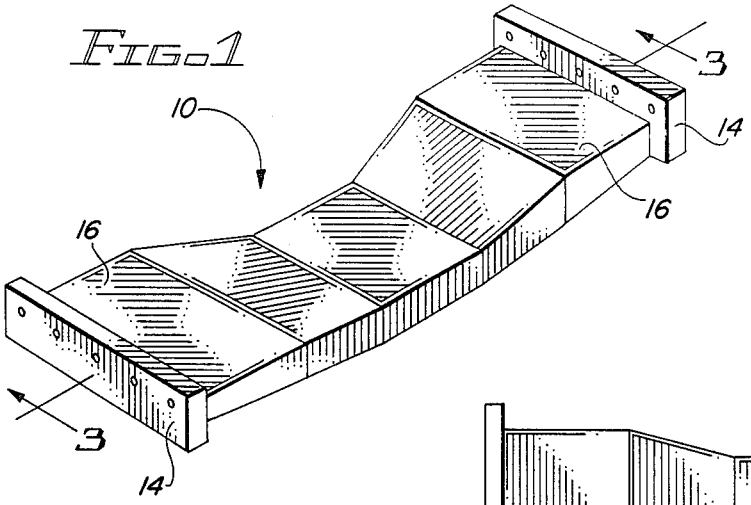
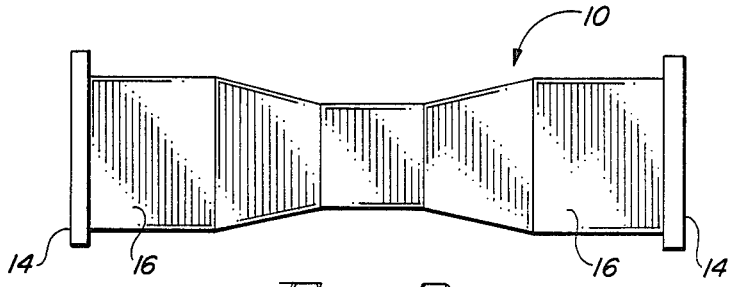
FIG. 2
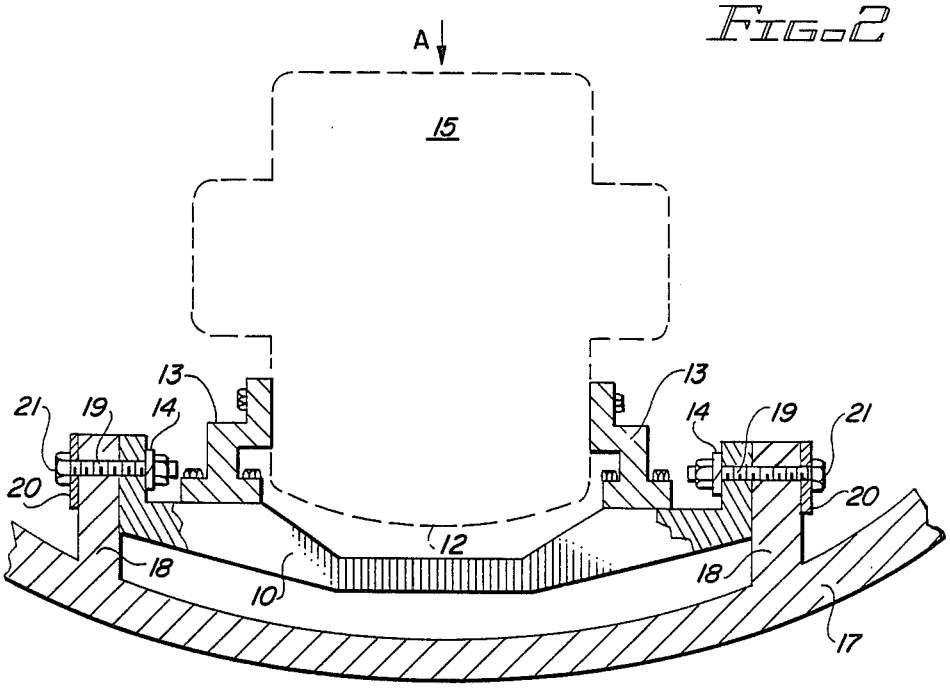
FIG. 3

ENGINE BED FOR INBOARD-POWERED BOATS

This invention relates to an engine bed for locating an inboard powerboat engine in a boat hull.

More particularly, the invention concerns an engine bed which can be pre-assembled with the engine prior to lowering the engine into the hull and attaching the assembly to longitudinal load-bearing stringers formed integrally with the hull.

In yet another respect, the invention pertains to an engine bed of lightweight construction, adapted for pre-assembly with the engine and which is attached to load-bearing hull stringers by through-bolting rather than by lag bolts.

When inboard engines are intstalled in powerboat hulls, particularly hulls formed of fiberglass-reinforced plastic, it is conventional practice to provide load-bearing lontigudinal stringers formed integrally in the stern portion of the hull and attach the motor mounts of the engine either directly to the stringer (e.g., by lag bolts) or attach the engine mounts to a transverse beam called an "engine bed" which, in turn, is attached to the stringers by through-bolting. In the latter case, it is conventional practice to install the engine bed across the stringers, then lower the engine into place and attach the motor mounts to the engine bed. This is a time-consuming and difficult procedure, as the vertical clearances between the engine and the bed and between the bed and the bottom of the hull are usually confined. Furthermore, attachment of the engine bed to the stringers is conventionally accomplished by lag bolts which have a tendancy to loosen during use, allowing the engine to be displaced from its normal operating position, leading to other practical difficulties.

It would be highly desirable to provide an engine bed specially adapted for pre-assembly with the engine prior to lowering the engine into the hull.

Additionally, it would be highly desirable to provide an engine bed which is attached to the load-bearing stringers by through-bolting which is easier to accomplish and which provides a much more secure mounting for the engine.

Accordingly, it is the principal object of the present invention to provide an improved engine bed for installing inboard engines in a powerboat hull.

Yet another object of the invention is to provide such an engine bed which can be conveniently manufactured and pre-assembled with the engine prior to lowering the assembly into the hull.

Yet another object of the invention is to provide an engine bed which is attached to the longitudinal load-bearing stringers of the hull by through-bolting.

These and other, further and more specific objects and advantages of the invention will be apparent to those skilled in the art from the following detailed description thereof, taken in conjunction with the drawings, in which:

FIG. 1 is a perspective view of an engine bed constructed in accordance with the principles of the present invention;

FIG. 2 is a plan view of the engine bed of FIG. 1;

FIG. 3 is a sectional view of the engine bed of FIGS. 1–2 taken along section line 3—3 thereof, showing the mode of attachment of the engine bed, motor mounts and engine (shown in dashed lines) to the load-bearing stringers of a typical powerboat hull (shown in transverse cross-section); and Turning now to the drawings, in which the presently preferred embodiment of the invention is depicted for purposes of illustration and not by way of limitation on the scope of the invention, like reference numerals identify the same parts in the several views.

The engine bed generally indicated by reference numeral 10 is basically a transverse beam which is preferably formed as a single unitary article of manufacture by resin transfer molding utilizing high-temperature resistant materials which are well-known in the art. The materials of construction are pre-cut continuous fiberglass mat and woven roving formed in the RTM process with injection of isopthalic resin.

As shown, the beam 10 is generally U-shaped to accommodate the lower parts of an engine such as the oil pan 12 which extend below the motor mount brackets 13.

Longitudinal flanges 14 are formed integrally in the ends of the beam 10.

In use, the engine bed 10 is pre-assembled with the engine 15 by through-bolting the motor mounts 13 directly to end portions 16 of the beam 10. The resulting assembly of engine mounts 13 and engine bed 10 is then lowered into the hull 17 in the direction of the arrow A and the flanges 14 of the bed 10 are then attached to transversely spaced longitudinal load-bearing stringers 18 formed integrally with hull 17. This installation is accomplished by means of through-bolts 19 extending through the flanges 14, the stringers 18, backing plate 20 and nuts 21.

Having described my invention in such terms as to enable those skilled in the art to practice it, and having identified the presently preferred embodiment thereof, I claim:

1. For use in combination with an inboard-powered boat, said boat including:

a hull, and at least two transversely spaced, longitudinal, load-bearing stringers formed integrally in the stern portion of said hull, parallel to the centerline of said hull, an engine bed for locating an inboard engine and transferring static and dynamic engine loads to said stringers on either side of said engine, said engine bed comprising:

(a) a transverse beam shaped and dimensioned to extend between said stringers under the forward motor mounts of said engine;

(b) longitudinal flanges formed integrally in the ends of said transverse beam; p1 (c) means for rigidly fixing the forward motor mounts of said engine to said transverse beam at points spaced inwardly of said flanges, such that said beam intermediate said flanges supports said motor mounts; and (d) means for through-bolting said longitudinal flanges of said engine bed rigidly to said load bearing stringers.

* * * * *